US010498000B2

(12) United States Patent
Hadavy et al.

(10) Patent No.: US 10,498,000 B2
(45) Date of Patent: Dec. 3, 2019

(54) MICROWAVE OR MILLIMETER WAVE RF PART REALIZED BY DIE-FORMING

(71) Applicant: GAPWAVES AB, Göteborg (SE)

(72) Inventors: Farid Hadavy, Göteborg (SE); Per-Simon Kildal

(73) Assignee: Gapwaves AB, Göeborg (SE)

( * ) Notice: Subject to any disclaimer, the term of this patent is extended or adjusted under 35 U.S.C. 154(b) by 140 days.

(21) Appl. No.: 15/543,912

(22) PCT Filed: Jan. 19, 2015

(86) PCT No.: PCT/EP2015/050843

§ 371 (c)(1),
(2) Date: Jul. 14, 2017

(87) PCT Pub. No.: WO2016/116126

PCT Pub. Date: Jul. 28, 2016

(65) Prior Publication Data

US 2018/0026378 A1 Jan. 25, 2018

(51) Int. Cl.
*H01P 3/123* (2006.01)
*H01Q 21/00* (2006.01)
(Continued)

(52) U.S. Cl.
CPC ..... *H01P 3/123* (2013.01); *B21K 23/00* (2013.01); *H01P 1/211* (2013.01); *H01Q 1/38* (2013.01);
(Continued)

(58) Field of Classification Search
CPC .... H01Q 21/0087; H01Q 21/005; H01Q 1/38; H01Q 21/064; H01Q 13/10; H01Q 21/20;
(Continued)

(56) References Cited

U.S. PATENT DOCUMENTS 3,197,843 A 8/1965 Nippert
3,937,618 A 2/1976 Kirkham
(Continued)

FOREIGN PATENT DOCUMENTS

JP 60-66640 U 5/1985
JP S 63-207435 A 8/1988
(Continued)

OTHER PUBLICATIONS

International Search Report (PCT/ISA/210) dated Sep. 30, 2015, by the European Patent Office as the International Searching Authority for International Application No. PCT/EP2015/050843.
(Continued)

*Primary Examiner* — Rakesh B Patel
*Assistant Examiner* — Jorge L Salazar, Jr.
(74) *Attorney, Agent, or Firm* — Buchanan Ingersoll & Rooney P.C.

(57) ABSTRACT

A method and apparatus for producing an RF part of an antenna system is disclosed, as well as thereby producible RF parts. The RF part has at least one surface provided with a plurality of protruding elements. In particular, the RF part may be a gap waveguide. The protruding elements are monolithically formed and fixed on a conducting layer, and all protruding elements are connected electrically to each other at their bases via the conductive layer. The RF part is produced by providing a die having a plurality of recessions forming the negative of the protruding elements of the RF part. The die may be a multilayer die, having several layers, at least some having through-holes to form the recessions. A formable piece of material is arranged on the die, and pressure is applied, thereby compressing the formable piece of material to conform with the recessions of the die.

10 Claims, 10 Drawing Sheets

(51) Int. Cl.

| | |
|---|---|
| ***B21K 23/00*** | (2006.01) |
| ***H01P 1/211*** | (2006.01) |
| ***H01Q 1/38*** | (2006.01) |
| ***H01Q 21/06*** | (2006.01) |
| *H01P 1/20* | (2006.01) |
| *H01Q 13/02* | (2006.01) |
| *H01Q 13/10* | (2006.01) |
| *H01Q 21/20* | (2006.01) |

(52) U.S. Cl.
CPC ..... *H01Q 21/005* (2013.01); *H01Q 21/0087* (2013.01); *H01Q 21/064* (2013.01); *H01P 1/2005* (2013.01); *H01Q 13/0283* (2013.01); *H01Q 13/10* (2013.01); *H01Q 13/106* (2013.01); *H01Q 21/0037* (2013.01); *H01Q 21/20* (2013.01)

(58) Field of Classification Search
CPC ..... H01Q 13/0283; H01Q 13/106; H01Q 21/0037; B21K 23/00; H01P 1/211; H01P 3/123; H01P 1/2005; H01P 3/121; H01P 3/21; H01P 3/16
USPC .... 333/25, 26, 113, 137, 157, 208, 239, 248
See application file for complete search history.

(56) References Cited

U.S. PATENT DOCUMENTS

| | | | | |
|---|---|---|---|---|
| 5,214,394 | A * | 5/1993 | Wong | H01Q 13/0258 330/286 |
| 6,134,783 | A | 10/2000 | Bargman et al. | |
| 7,146,713 | B1 | 12/2006 | Ying | |
| 2005/0073463 | A1 | 4/2005 | Bayar et al. | |
| 2011/0187614 | A1 | 8/2011 | Kirino et al. | |
| 2014/0054023 | A1 | 2/2014 | Kokubo et al. | |

FOREIGN PATENT DOCUMENTS

| | | | |
|---|---|---|---|
| JP | 2007243697 | A | 9/2007 |
| WO | 2010050122 | A1 | 5/2010 |
| WO | 2012118094 | A1 | 9/2012 |
| WO | 2015/172948 | A2 | 11/2015 |

OTHER PUBLICATIONS

Written Opinion (PCT/ISA/237) dated Sep. 30, 2015, by the European Patent Office as the International Searching Authority for International Application No. PCT/EP2015/050843.

Kirino et al., A 76 GHz Multi-Layered Phased Array Antenna Using a Non-Metal Contact Metamaterial Waveguide, *IEEE Transactions on Antennas and Propagation*, Feb. 1, 2012, pp. 840-853, vol. 60, No. 2, IEEE Service Center, Piscataway, NJ, U.S.A. (DOI:10.1109/TAP.2011.2173112).

Hesler, A Photonic Crystal Joint (PCJ) for Metal Waveguides, *2001 IEEE MTT-S International Microwave Symposium Digest* (*IMS 2001*), May 20-25, 2001, pp. 783-786, IEEE MTT-S International Microwave Symposium, New York, NY, U.S.A. (DOI: 10.1109/MWSYM.2001.967009).

Zaman et al., Gap Waveguide PMC Packaging for Improved Isolation of Circuit Components in High-Frequency Microwave Modules, *IEEE Transactions on Components, Packaging and Manufacturing Technology*, Jan. 1, 2014, pp. 16-25, vol. 4, No. 1, IEEE, U.S.A. (DOI:10.1109/TCPMT.2013.2271651).

Valero-Nogueira et al., Gap Waveguides Using a Suspended Strip on a Bed of Nails, *IEEE Antennas and Wireless Propagation Letters*, Jan. 1, 2011, pp. 1006-1009, vol. 10, IEEE, Piscataway, NJ, U.S.A. (DOI:10.1109/LAWP.2011.2167591).

Kildal et al., Design and experimental verification of ridge gap waveguide in bed of nails for parallel-plate mode suppression, *IET Microwaves Antennas & Propagation*, Feb. 21, 2011, pp. 262-270, vol. 5, No. 3, The Institution of Engineering and Technology, www.iedtl.org. (DOI:10.1049/IET-MAP:20100089).

Office Action (Communication pursuant to Article 94(3) EPC) dated Jul. 5, 2018, by the European Patent Office in corresponding European Application No. 15 700 488.8-1205. (12 pages).

Zaman a. u. et al."Design of a Simple Transition From Microstrip to Ridge Gap Waveguide Suited for MMIC and Antenna Integration" IEEE Antennas and Wireless Propagation Letters, vol. 12, 2013, pp. 1558-1561.

Molaei B. et al."A Novel Wideband Microstrip Line to Ridge Gap Waveguide Transition Using Defected Ground Slot" IEEE, Microwave and Wireless Components Letters, vol. 25, Issue 2, pp. 91-93. Feb. 2015.

Office Action (Notice of Reasons for Refusal) dated Feb. 19, 2019, by the Japanese Patent Office in corresponding Japanese Patent Application No. 2017-535407, and an English Translation of the Office Action, (14 pages).

* cited by examiner

MICROWAVE OR MILLIMETER WAVE RF PART REALIZED BY DIE-FORMING

TECHNICAL FIELD OF THE INVENTION

The present invention relates to the technology used to design, integrate and package the radio frequency (RF) part of an antenna system, for use in communication, radar or sensor applications, and e.g. components such as waveguide couplers, diplexers, filters, antennas, integrated circuit packages and the like.

BACKGROUND

There is a need for technologies for fast wireless communication in particular at 60 GHz and above, involving high gain antennas, intended for consumer market, so low-cost manufacturability is a must. The consumer market prefers flat antennas, and these can only be realized as flat planar arrays, and the wide bandwidth of these systems require corporate distribution network. This is a completely branched network of lines and power dividers that feed each element of the array with the same phase and amplitude to achieve maximum gain.

A common type of flat antennas is based on a microstrip antenna technology realized on printed circuits boards (PCB). The PCB technology is well suited for mass production of such compact lightweight corporate-fed antenna arrays, in particular because the components of the corporate distribution network can be miniaturized to fit on one PCB layer together with the microstrip antenna elements. However, such microstrip networks suffer from large losses in both dielectric and conductive parts. The dielectric losses do not depend on the miniaturization, but the conductive losses are very high due to the miniaturization. Unfortunately, the microstrip lines can only be made wider by increasing substrate thickness, and then the microstrip network starts to radiate, and surface waves starts to propagate, both destroying performance severely.

There is one known PCB-based technology that have low conductive losses and no problems with surface waves and radiation. This is referred to by either of the two names substrate-integrated waveguide (SIW), or post-wall waveguide as in [1]. We will herein use the term SIW only. However, the SIW technology still has significant dielectric losses, and low loss dielectric materials are very expensive and soft, and therefore not suitable for low-cost mass production. Therefore, there is a need for better technologies.

Thus, there is a need for a flat antenna for high frequencies, such as at or above 60 GHz, and with reduced dielectric losses and problems with radiation and surface waves. In particular, there is a need for a PCB based technology for realizing corporate distribution networks at 60 GHz or above that do not suffer from dielectric losses and problems with radiation and surface waves.

The gap waveguide technology is based on Prof. Kildal's invention from 2008 & 2009 [2], also described in the introductory paper [3] and validated experimentally in [4]. This patent application as well as the paper [5] describes several types of gap waveguides that can replace microstrip technology, coplanar waveguides, and normal rectangular waveguides in high frequency circuits and antennas.

The gap waveguides are formed between parallel metal plates. The wave propagation is controlled by means of a texture in one or both of the plates. Waves between the parallel plates are prohibited from propagating in directions where the texture is periodic or quasi-periodic (being characterized by a stopband), and it is enhanced in directions where the texture is smooth like along grooves, ridges and metal strips. These grooves, ridges and metal strips form gap waveguides of three different types: groove, ridge and microstrip gap waveguides [6], as described also in the original patent application [2].

The texture can be a periodic or quasi-periodic collection of metal posts or pins on a flat metal surface, or of metal patches on a substrate with metallized via-holes connecting them to the ground plane, as proposed in [7] and also described in the original patent application [2]. The patches with via-holes are commonly referred to as mushrooms.

A suspended (also called inverted) microstrip gap waveguide was presented in [8] and is also inherent in the descriptions in [6] and [7]. This consists of a metal strip that is etched on and suspended by a PCB substrate resting on top of a surface with a regular texture of metal pins. This substrate has no ground plane. The propagating quasi-TEM wave-mode is formed between the metal strip and the upper smooth metal plate, thereby forming a suspended microstrip gap waveguide.

This waveguide can have low dielectric and conductive losses, but it is not compatible with PCB technology. The textured pin surface could be realized by mushrooms on a PCB, but this then becomes one of two PCB layers to realize the microstrip network, whereby it would be much more costly to produce than gap waveguides realized only using one PCB layer. Also, there are many problems with this technology: It is difficult to find a good wideband way of connecting transmission lines to it from underneath.

The microstrip gap waveguide with a stopband-texture made of mushrooms were in [9] realized on a single PCB. This PCB-type gap waveguide is called a microstrip ridge gap waveguide, because the metal strip must have via-holes in the same way as the mushrooms.

A quasi-planar inverted microstrip gap waveguide antenna is described in [10]-[12]. It is expensive both to manufacture the periodic pin array under the microstrip feed network on the substrate located directly upon the pin surface, and the radiating elements which in this case were compact horn antennas.

A small planar array of 4×4 slots were presented in [13]. The antenna was realized as two PCBs, an upper one with the radiating slots realized as an array of 2×2 subarrays, each consisting of 2×2 slots that are backed by an SIW cavity. Each of the 4 SIW cavities was excited by a coupling slot fed by a microstrip-ridge gap waveguide in the surface of a lower PCB located with an air gap below the upper radiating PCB. It was very expensive to realize the PCBs with sufficient tolerances, and in particular to keep the air gap with constant height. The microstrip-ridge gap waveguide also requires an enormous amount of thin metallized via holes that are very expensive to manufacture. In particular, the drilling is expensive.

There is therefore a need for a new waveguide and RF packaging technology that have good performance and in addition is cost-efficient to produce.

SUMMARY OF THE INVENTION

It is therefore an object of the present invention to alleviate the above-discussed problems, and specifically to provide a new waveguide and RF packaging technology, which has good performance and which is cost-efficient to produce, in particular for use above 30 GHz, and e.g. for use in an antenna system for use in communication, radar or sensor applications.

According to a first aspect of the invention there is provided a method for producing an RF part of an antenna system, e.g. for use in communication, radar or sensor applications, the RF part being provided with a plurality of protruding element protruding from a base surface of the RF part, the method comprising:

providing a die being provided with a plurality of recessions forming the negative of the protruding elements of the RF part;

arranging a formable piece of material on the die; and applying a pressure on the formable piece of material, thereby compressing the formable piece of material to conform with the recessions of the die.

By RF part is in the context of the present application meant a part of an antenna system used in the radio frequency transmitting and/or receiving sections of the antenna system, sections which are commonly referred to as the front end or RF front end of the antenna system. The RF part may be a separate part/device connected to other components of the antenna system, or may form an integrated part of the antenna system or other parts of the antenna system. The waveguide and RF packaging technology of the present invention are in particular suitable for realizing a wideband and efficient flat planar array antenna. However, it may also be used for other parts of the antenna system, such as waveguides, filters, integrated circuit packaging and the like, and in particular for integration and RF packaging of such parts into a complete RF front-end or antenna system. In particular, the present invention is suitable for realization of RF parts being or comprising gap waveguides.

In a gap waveguide, the waves propagate mainly in the air gap between two conducting layers, where at least one is provided with a surface texture, here being formed by the protruding elements. The gap can also be filled fully or partly by dielectric material, of mechanical reasons to keep the gap of constant height. The gap can even have metal elements for mechanically supporting the gap at constant height. These metal elements are then preferably located outside the traces of the waveguiding structure.

The protruding elements are preferably arranged in a periodic or quasi-periodic pattern in the textured surface, and are designed to stop waves from propagating between the two metal surfaces, in other directions than along the waveguiding structure. The frequency band of this forbidden propagation is called the stopband, and this defines the maximum available operational bandwidth of the gap waveguide.

As discussed in the foregoing, the groove gap waveguide, the microstrip ridge gap waveguide and the inverted microstrip gap waveguide, have already been demonstrated to work and have lower loss than conventional microstrip lines and coplanar waveguides. The present inventors have now found that similar or better performance can be obtained in a much more cost-effective way by forming the protruding elements monolithically on a conducting layer in a process that may be referred to as die forming or coining, and in particular multilayer die forming, in which a formable piece of material, such as aluminium, is pressed towards a die being provided with a plurality of recessions forming the negative of the protruding elements of the RF part, thereby compressing the formable piece of material to conform with the recessions of the die. Hereby, it is e.g. possible to realize corporate distribution networks at low manufacturing cost and to sufficient accuracy at 60 GHz and higher frequencies.

The die may be provided in one layer, comprising the recessions. However, the die may alternatively comprise two or more layers, at least some of which are provided with through-holes, wherein the recessions are formed by stacking the layers on top of each other. Coining or die forming using such multi-layered dies are here referred to as multi-layer die forming. In case three, four, five or even more layers are used, each layer, apart from possibly the bottom layer, has through-holes which appear as recessions when the layers are put on top of each other, and at least some of the throughholes of the different layers being in communication with each other.

Coining or die forming is per se previously known, and has been used in other fields for forming metal sheets and the like. Examples of such known methods are found in e.g. U.S. Pat. Nos. 7,146,713, 3,937,618 and U.S. Pat. No. 3,197,843. However, the use of a coining or die forming for production of RF parts of the above-discussed type is neither known nor foreseen in the prior art. The use of a multi-layer die and multilayer die forming are also not known.

The recessions in the die can be formed by means of drilling, milling or the like.

It has now been realized that such a coining/die forming process can be used to manufacture the pin/protruding element surfaces of gap waveguides for a very low price compared to conventional milling of metal plates, and also compared to drilling via holes in a dielectric substrate.

The present invention makes production of RF part of the above-discussed type possible in a quick and cost-effective way, both for production of prototypes and test series, and for full-scale production. The same production equipment may be used for production of many different RF parts. For production of different RF parts, only the die need to be replaced, and in case several die layers are used (see below), it is often sufficient only to replace a single die layer, or to rearrange the order of the die layers.

The recessions in the die or a die layer may be obtained by drilling. However, other means for forming the recessions are also feasible, such as milling, etching, laser cutting or the like are also feasible.

The formable piece of material may be referred to as a billet. The billet is preferably formed by material which is softer than the material of the other components, and in particular the die. The billet/formable material may e.g. be a soft metal, such as aluminum, tin or the like, or other materials, such as a plastic material. If a plastic material or other non-conductive or poorly conductive material is used, the material is preferably plated or metallized after forming, e.g. with a thin plating of silver. The die is preferably made of stainless steel, or other hard metal.

The recessions of the die/die layer may be formed in various ways, such as by drilling, milling, etching, laser cut, or the like.

The present invention makes it possible to cost-efficiently produce RF parts having many protruding elements/pins, protruding elements/pins of small diameter, and/or protruding elements/pins having a great height compared to the diameter. This make it particularly suited for forming RF parts for high frequencies.

The depth of the recessions, and the thickness of the die/die layer carrying the recessions (especially when through-holes are used), provide the height of the protruding structure of the manufactured part, such as pins and/or ridges. Hereby, the height of such elements are easily controllable, and may also easily be arranged to vary over the manufactured parts, so that e.g. some pins are higher than other, the pins are higher than a protruding ridge, etc.

Through-holes are more cost-effective to manufacture than cavities. Further, recessions of different depths can hereby easily be obtained by locating die-layers with through-holes on top of each other, so that deeper recessions are obtained if two or more die-layers have coinciding hole locations.

By means of the present invention, RF parts of the above-discussed type can be produced in a very quick, energy-efficient and cost-effective way. The forming of the die layer is relatively simple, and the same die layer may be reused many times. Further, the die layer can easily be exchanged, enabling reuse of the rest of the die and production equipment for production of other RF-parts. This makes the production flexible to design changes and the like. The production process is also very controllable, and the produced RF parts have excellent tolerances. Further, the production equipment is relatively inexpensive, and at the same time provides high productivity. Thus, the production method and apparatus is suitable both for low volume prototype production, production of small series of customized parts, and for mass production of large series.

The die is preferably provided with a collar in which the formable piece of material is insertable. The die may comprise a base plate and a collar, the collar being provided as a separate element, loosely arranged on the base plate.

The die may further comprise at least one die layer comprising through-holes forming said recessions. In a preferred embodiment, the die comprises at least two sandwiched die layers comprising through-holes. Hereby, the sandwiched layers may be arranged to provide various heights and/or shapes of the protruding elements. For example, such sandwiched die layers may be used for cost-efficient realization of protruding elements having varying heights, such as areas of protruding elements of different heights, or realization of protruding element having varying width dimensions, such as being conical, having a stepwise decreasing width, or the like. It may also be used to form ridges, stepped transitions, etc. Preferably, the at least one die layer is arranged within the collar.

The recessions may be arranged to form a set of periodically or quasi-periodically arranged protruding elements on the RF part.

According to another aspect of the invention, there is provided a radio frequency (RF) part of an antenna system, e.g. for use in communication, radar or sensor applications, comprising at least two conducting layers arranged with a gap there between, and a set of periodically or quasi-periodically arranged protruding elements fixedly connected to at least one of said conducting layers, thereby forming a texture to stop wave propagation in a frequency band of operation in other directions than along intended waveguiding paths, wherein said protruding elements are monolithically formed on said at least one conducting layer, whereby each pin is monolithically fixed to the conducting layer, all protruding elements being connected electrically to each other at their bases via said conductive layer on which they are fixedly connected.

Hereby, the protruding elements are all monolithically integrated with the upper or lower conducing layer, and are preferably all in conductive metal contact with the conducing layer and neighboring protruding elements.

The protruding elements are preferably monolithically formed on the conducting layer by coining, in the way discussed in the foregoing.

In one embodiment, the RF part is a waveguide, and wherein the protruding elements are further in contact with, and preferably fixedly connected to, also the other conducting layer, and wherein the protruding elements are arranged to at least partly surround a cavity between said conducting layers, said cavity thereby functioning as a waveguide. Hereby, the protruding elements may be arranged to at least partly provide the walls of a tunnel or a cavity connecting said conducting layers across the gap between them, said tunnel thereby functioning as a waveguide or a waveguide cavity. Thus, in this embodiment, a smooth upper plate (conducting layer) can also rest on the grid array formed by the protruding elements of the other conducting layer, or on some part of it, and the protruding elements/pins that provide the support can e.g. be soldered to the upper smooth metal plate (conducting layer) by baking the construction in an oven. Thereby, it is possible to form post-wall waveguides as described in [1], said documents hereby being incorporated in its entirety by reference, but without any substrate inside the waveguide. Thus, SIW waveguides are provided without the substrate so to say. Such rectangular waveguide technology is advantageous compared to conventional SIW because it reduces the dielectric losses, since there is no substrate inside the waveguide, and the rectangular waveguides can also be produced more cost-effectively, and since the use of expensive lowloss substrate material may now be reduced or even omitted.

Further, the RF part may be a gap waveguide, and further comprising at least one groove, ridge or microstrip line along which waves are to propagate. The microstrip may be arranged as a suspended microstrip. The microstrip may also be arranged overlying or underlying a grid array of pins, in a "bed of nail" arrangement.

The RF part is preferably a gap waveguide, and further comprising at least one ridge along which waves are to propagate, said ridge being arranged on the same conducting layer as the protruding elements, and also being monolithically formed on said conducting layer.

The protruding elements may have maximum cross-sectional dimensions of less than half a wavelength in air at the operating frequency, and/or wherein the protruding elements in the texture stopping wave propagation are spaced apart by a spacing being smaller than half a wavelength in air at the operating frequency.

The protruding elements forming said texture to stop wave propagation may further be in contact with both conducting layers, or with only one of the conducting layers.

At least one of the conducting layers may further be provided with at least one opening, preferably in the form of rectangular slot(s), said opening(s) allowing radiation to be transmitted to and/or received from said RF part.

Also, the protruding elements in the texture stopping wave propagation may be preferably spaced apart by a spacing being smaller than half a wavelength in air at the operating frequency. This means that the separation between any pair of adjacent protruding elements in the texture is smaller than half a wavelength.

The RF part may further comprise at least one integrated circuit module, such as a monolithic microwave integrated circuit module, arranged between said conducting layers, the texture to stop wave propagation thereby functioning as a means of removing resonances within the package for said integrated circuit module(s). The integrated circuit module(s) may be arranged on a conducting layer not being provided with said protruding elements, and wherein protruding elements overlying the integrated circuit(s) are shorter than protruding elements not overlying said integrated circuit(s).

According to yet another aspect of the present invention, there is provided a flat array antenna comprising a corporate distribution network realized by an RF part as discussed above.

The gap waveguide may form the distribution network of an array antenna. The distribution network is preferably fully or partly corporate containing power dividers and transmission lines, realized fully or partly as a gap waveguide, i.e. formed in the gap between one smooth and one textured surface, including either a ridge gap waveguide, groove gap waveguide and/or a microstrip gap waveguide, depending on whether the waveguiding structure in the textured surface is a metal ridge, groove or conducting strip on a thin dielectric substrate. The latter can be an inverted microstrip gap waveguide, or a microstrip-ridge gap waveguide as defined by known technology.

In a distribution network, the waveguiding structure may be formed like a tree to become a branched or corporate distribution network by means of power dividers and lines between them. The pins surrounding the waveguiding groove, ridge or metal strip may be monolithically integrated with the supporting metal plate or metallized substrate by the same production procedure as discussed above.

The protruding elements, or pins, may have any cross-sectional shape, but preferably have a square, rectangular or circular cross-sectional shape. Further, the protruding elements preferably have maximum cross-sectional dimensions of smaller than half a wavelength in air at the operating frequency. Preferably, the maximum dimension is much smaller than this. The maximum cross-sectional dimension is the diameter in case of a circular cross-section, or diagonal in case of a square or rectangular cross-section.

In a preferred embodiment, the protruding elements forming said texture to stop wave propagation are formed as a pin grid array.

At least one of the conducting layers may further be provided with at least one opening, preferably in the form of rectangular slot(s), said opening(s) allowing radiation to be transmitted to and/or received from said gap waveguide. Such an opening may be used either as radiating openings in an array antenna, or as a coupling opening to transfer radiation to another layer of the antenna system. The openings may preferably be arranged in the smooth metal surface of the gap waveguide, i.e. in the conducting layer not being provided with the protruding elements, and the slots may be arranged to radiate directly from its upper side, in which case the spacing between each slot preferably is smaller than one wavelength in free space.

The antenna system may further comprise horn shaped elements connected to the openings in the metal surface of the gap waveguide. Such slots are coupling slots that make a coupling to an array of horn-shaped elements which are preferably located side-by-side in an array in the upper metal plate/conducting layer. The diameter of each horn element is preferably larger than one wavelength. An example of such horn array is per se described in [10], said document hereby being incorporated in its entirety by reference.

When several slots are used as radiating elements in the upper plate, the spacing between the slots is preferably smaller than one wavelength in air at the operational frequency.

The slots in the upper plate may also have a spacing larger than one wavelength. Then, the slots are coupling slots, which makes a coupling from the ends of a distribution network arranged in the textured surface to a continuation of this distribution network in a layer above it, that divides the power equally into an array of additional slots that together form a radiating an array of subarray of slots, wherein the spacing between each slot of each subarray preferably is smaller than one wavelength. Hereby, the distribution network may be arranged in several layers, thereby obtaining a very compact assembly. For example, first and second gap waveguide layers may be provided, in the aforementioned way, separated by a conductive layer comprising the coupling slots, each of which make a coupling from each ends of the distribution network on the textured surface to a continuation of this distribution network that divides the power equally into a small array of slots formed in a conducting layer arranged at the upper side of the second gap waveguide, that together form a radiating subarray of the whole array antenna. The spacing between each slot of the subarray is preferably smaller than one wavelength. Alternatively, only one of said waveguide layers may be a gap waveguide layer, whereby the other layer may be arranged by other waveguide technology.

The distribution network is at the feed point preferably connected to the rest of the RF front-end containing duplexer filters to separate the transmitting and receiving frequency bands, and thereafter transmitting and receiving amplifiers and other electronics. The latter are also referred to as converter modules for transmitting and receiving. These parts may be located beside the antenna array on the same surface as the texture forming the distribution network, or below it. A transition is preferably provided from the distribution network to the duplexer filter, and this may be realized with a hole in the ground plane of the lower conducting layer and forming a rectangular waveguide interface on the backside of it. Such rectangular waveguide interface can also be used for measurement purposes.

The antenna system may also comprise at least one integrated circuit arranged between two of the conducting layers of the waveguide and RF packaging technology, the texture to stop wave propagation thereby removing resonances in the cavity inside which said integrated circuit(s) is located. In a preferred such embodiment, the at least one integrated circuit is a monolithic microwave integrated circuit (MMIC).

Preferably, the integrated circuit(s) is arranged on a conducting layer not being provided with said protruding elements, and wherein protruding elements overlying the integrated circuit(s) are shorter than protruding elements not overlying said integrated circuit(s). Hereby, the integrated circuit(s) may be somewhat embraced by the protruding elements, thereby providing enhanced shielding and protection. However, the protruding elements are preferably not in contact with the integrated circuit(s), and also preferably not in contact with the conducting layer on which the integrated circuit(s) is arranged.

According to another aspect of the invention, there is provided a flat array antenna comprising a corporate distribution network realized by a RF part in accordance with the discussion above.

Hereby, similar embodiments and advantages as discussed above are feasible.

Preferably, the corporate distribution network forms a branched tree with power dividers and waveguide lines between them. This may e.g. be realized as gap waveguides as discussed in the foregoing.

The antenna may also be an assembly of a plurality of sub-assemblies, in the way already discussed in the forgoing, whereby the total radiating surface of the antenna is formed by the combination of the radiating sub-assembly surfaces of the sub-assemblies. Each such sub-assembly surface may be provided with an array of radiating slot openings, as discussed in the foregoing. The sub-assembly surfaces may e.g. be arranged in a side-by-side arrangement, to form a square or rectangular radiating surface of the assembly. Preferably, one or more elongated slots working as corrugations may further be arranged between the sub-arrays, i.e. between the sub-assembly surfaces, in the E-plane.

Hereby, similar embodiments and advantages as discussed above are feasible.

In one line of embodiments, the second conducting layer is arranged in contact with at least some of the protruding elements of the first conducing layer, and connected to said protruding elements, e.g. by soldering. Thus, the smooth surface of the second conducting layer can be laid to rest on the monolithically formed protruding elements and first conducting layer or on some part of it, and the protruding elements/pins that provide the support can be soldered to the upper smooth metal plate by baking the construction in an oven. Hereby, it is possible to form post-wall waveguides as described in [1], as discussed in the previous, but without any substrate inside the waveguide. Thus, as also discussed in the foregoing, SIW waveguides without substrate(s) are provided.

However, connection of the two conducting layers together may also be accomplished in other ways, such as e.g. connecting the layers together by means of a surrounding frame or the like.

The ridge gap waveguide makes use of a ridge between the pins to guide the waves. Such ridges may also be monolithically formed in the above-discussed manner, by pressing the formable material into a recesses in die. Then, this waveguiding ridge structure, which may have the form of a tree if it is used to realize a branched distribution network, can be formed in between the protruding elements, formed simultaneously.

According to yet another aspect of the present invention, there is provided an apparatus for producing an RF part of an antenna system, e.g. for use in communication, radar or sensor applications, the RF part being provided with a plurality of protruding element protruding from a base surface of the RF part, the apparatus comprising:

a die comprising:

at least one die layer being provided with a plurality of recessions forming the negative of the protruding elements of the RF part;

a collar arranged around said at least one die layer;

a base plate on which said at least one die layer and said collar are arranged;

a stamp arranged within the collar, to press a formable piece of material towards the at least one die layer; and a pressure arrangement to apply pressure between the stamp and the base plate of the die, thereby compressing the formable piece of material to conform with the recessions of the at least one die layer.

The stamp is a here a piece of material arranged to convey an equal pressure on the formable piece of material. The stamp may also be referred to as a dummy, dummy block, punch or planar punch.

Hereby, similar embodiments and advantages as discussed above are feasible.

The at least one die layer preferably comprises through-holes forming said recessions. Such a die layer is relatively simple to manufacture, since through-holes may e.g. be produced by drilling. Further, in a preferred embodiment, the die comprises at least two sandwiched die layers comprising through-holes. This makes it easy e.g. to produce protruding elements and/or ridges having various heights.

These and other features and advantages of the present invention will in the following be further clarified with reference to the embodiments described hereinafter. Notably, the invention is in the foregoing described in terms of a terminology implying a transmitting antenna, but naturally the same antenna may also be used for receiving, or both receiving and transmitting electromagnetic waves. The performance of the part of the antenna system that only contains passive components is the same for both transmission and reception, as a result of reciprocity. Thus, any terms used to describe the antenna above should be construed broadly, allowing electromagnetic radiation to be transferred in any or both directions. E.g., the term distribution network should not be construed solely for use in a transmitting antenna, but may also function as a combination network for use in a receiving antenna.

BRIEF DESCRIPTION OF THE DRAWINGS

For exemplifying purposes, the invention will be described in closer detail in the following with reference to embodiments thereof illustrated in the attached drawings, wherein:

FIG. 3*a* is an exploded view of a subarray/sub-assembly of said antenna, FIG. 3*b* is a perspective view of an antenna comprising four such subarrays/sub-assemblies, and FIG. 3*c* is a perspective view of an alternative way of realizing the antenna of FIG. 3*b*;

FIG. 9 is an illustration of a gap waveguide packaged MMIC amplifier chains, in accordance with a further embodiment of the present invention, and where

DETAILED DESCRIPTION OF PREFERRED EMBODIMENTS

In the following detailed description, preferred embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of e present invention, it will be apparent to one skilled in the art that the present invention may be practiced without these specific details. In other instances, well-known constructions or functions are not described in detail, so as not to obscure the present invention.

Figure 1:
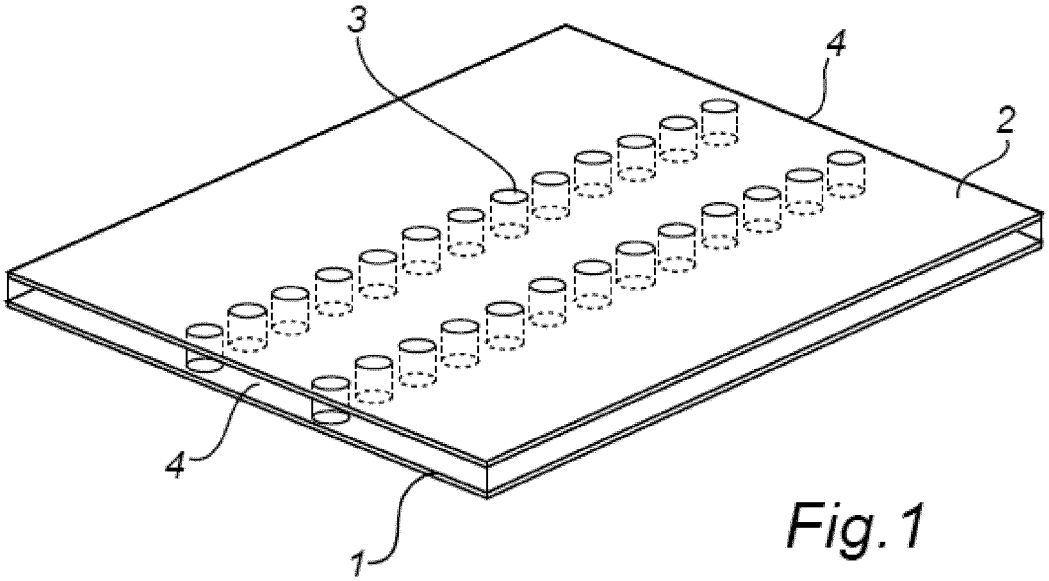
FIG. 1 is a perspective side view showing a gap waveguide in accordance with one embodiment of the present invention.

In a first embodiment, as illustrated in FIG. 1, an example of a rectangular waveguide is illustrated. The waveguide comprises a first conducting layer 1, and a second conducting layer 2 (here made semi-transparent, for increased visibility). The conducting layers are arranged at a constant distance h from each other, thereby forming a gap there between.

This waveguide resembles a conventional SIW with metallized via holes in a PCB with metal layer (ground) on both sides, upper (top) and lower (bottom) ground plane. However, here there is no dielectric substrate between the conducting layers, and the metallized via holes are replaced with a monolithic part comprising a conductive layer and protruding elements 3 extending from, and fixedly monolithically integrated with this first conducting layer. The second conducting layer 2 rest on the protruding elements 3, and is also connected to these, e.g. by means of soldering. The protruding elements 3 are made of conducting material, such as metal. They can also be made of metallized plastics or ceramics.

Similar to a SIW waveguide, a waveguide is here formed between the conducting elements, here extending between the first and second ports 4.

In this example, a very simple, straight waveguide is illustrated. However, more complicated paths may be realized in the same way, including curves, branches, etc.

Figure 2:
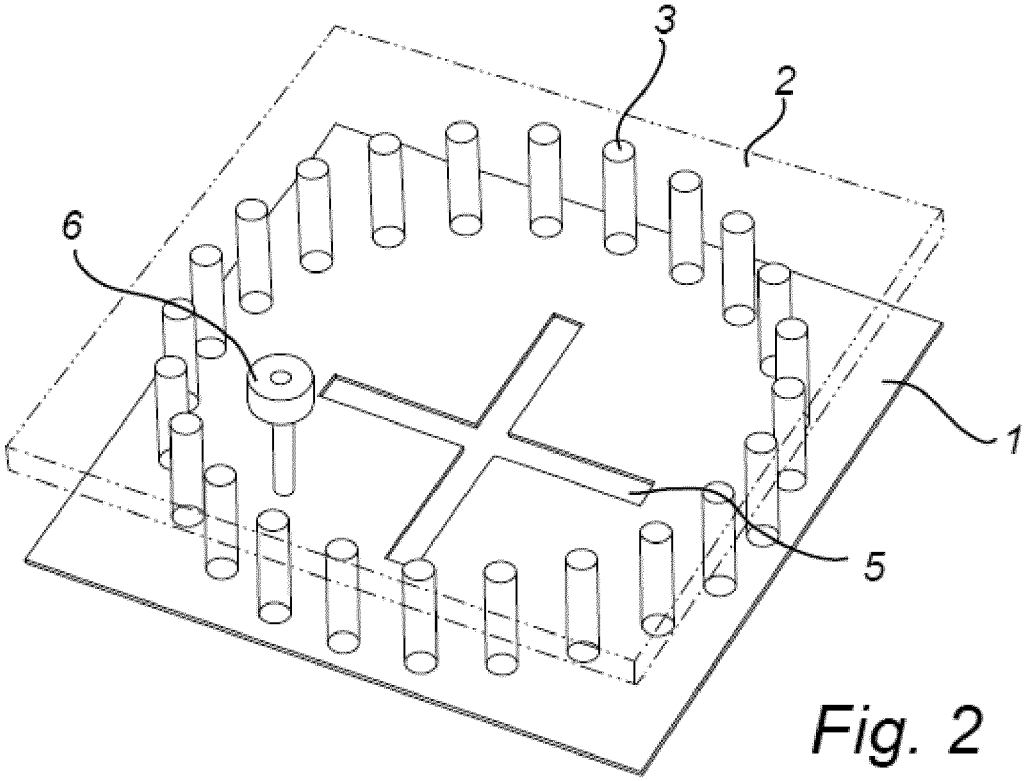
FIG. 2 is a perspective side view showing a circular cavity of a gap waveguide in accordance with another embodiment of the present invention.

FIG. 2 illustrates a circular cavity of a gap waveguide. This is realized in a similar way as in the above-discussed straight waveguide of FIG. 1, and comprises first and second conducting layers 1, 2, arranged with a gap there between, and protruding elements extending between the conducting layers, and connected to these layers. The protruding elements are monolithically connected to one of the conducting layers. The protruding elements 3 are here arranged along a circular path, enclosing a circular cavity. Further, in this exemplary embodiment, a feeding arrangement 6 and a X-shaped radiating slot opening 5 is provided.

This circular waveguide cavity functions in similar ways as circular SIW cavity.

Figure 3A:
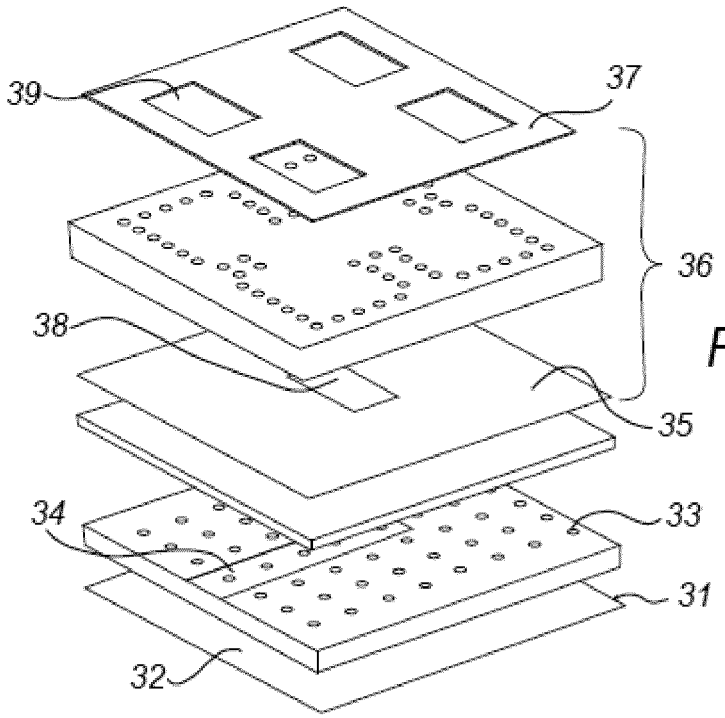
FIGS. 3*a*, 3*b*, and 3*c* show a schematic illustration of an array antenna in accordance with another embodiment of the present invention, where
Figure 3B:
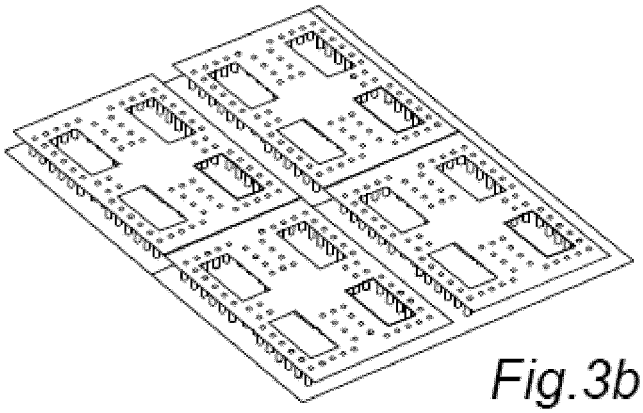
Figure 3C:
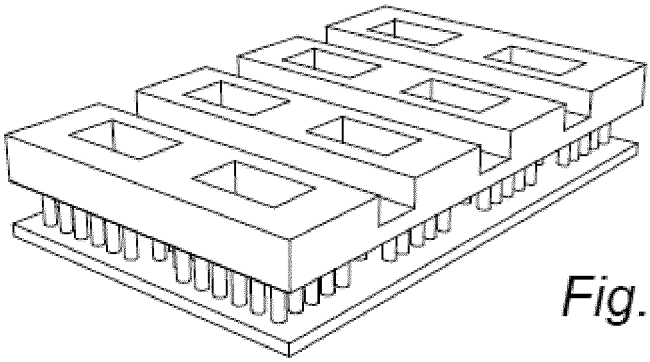

With reference to FIGS. 3*a*, 3*b*, and 3*c*, an embodiment of a flat array antenna will now be discussed. This antenna structurally and functionally resembles the antenna discussed in [13], said document hereby being incorporated in its entirety by reference.

FIG. 3*a* shows the multilayer structure of a sub-assembly in an exploded view. The sub-assembly comprises a lower gap waveguide layer 31 with a first ground plane/conducting layer 32, and a texture formed by protruding elements 33 and a ridge structure 34, together forming a gap waveguide between the first ground plane 32 and a second ground plane/conducting layer 35. The second ground plane 35 is here arranged on a second, upper waveguide layer 36, which also comprises a third, upper ground plane/conducting layer 37. The second waveguide layer may also be formed as a gap waveguide layer. A gap is thus formed between both the first and second ground planes and between the second and third ground planes, respectively, thereby forming two layers of waveguides. The bottom, second ground plane 35 of the upper layer has a coupling slot 38, and the upper one has 4 radiating slots 39, and between the two ground planes there is a gap waveguide cavity. FIG. 3*a* shows only a single subarray forming the unit cell (element) of a large array. FIG. 3*b* shows an array of 4 such subarrays, arranged side-by-side in a rectangular configuration. There may be even larger arrays of such subarrays to form a more directive antenna.

Between the subarrays, there is in one direction provided a separation, thereby forming elongated slots in the upper metal plate. Protruding elements/pins are arranged along both sides of the slots. This forms corrugations between the subarrays in E-plane.

In FIG. 3*c*, an alternative embodiment is shown, in which the upper conducting layer, including several sub-arrays, is formed as a continuous metal plate. This metal plate preferably has a thickness sufficient to allow grooves to be formed in it. Hereby, elongate corrugations having similar effects as the slots in FIG. 3*b* can instead be realized as elongate grooves extending between the unit cells.

Either or both of the waveguide layers between the first and second conducting layer and the second and third conducting layer, respectively, may be formed as monolithic gap waveguides as discussed in the foregoing, without any substrate between the two metal ground planes, and with protruding elements extending between the two conducting layers. Then, the conventional via holes, as discussed in [13], will instead be metal pins or the like, which are monolithically formed between the two metal plates, within each unit cell of the whole antenna array.

Figure 4:
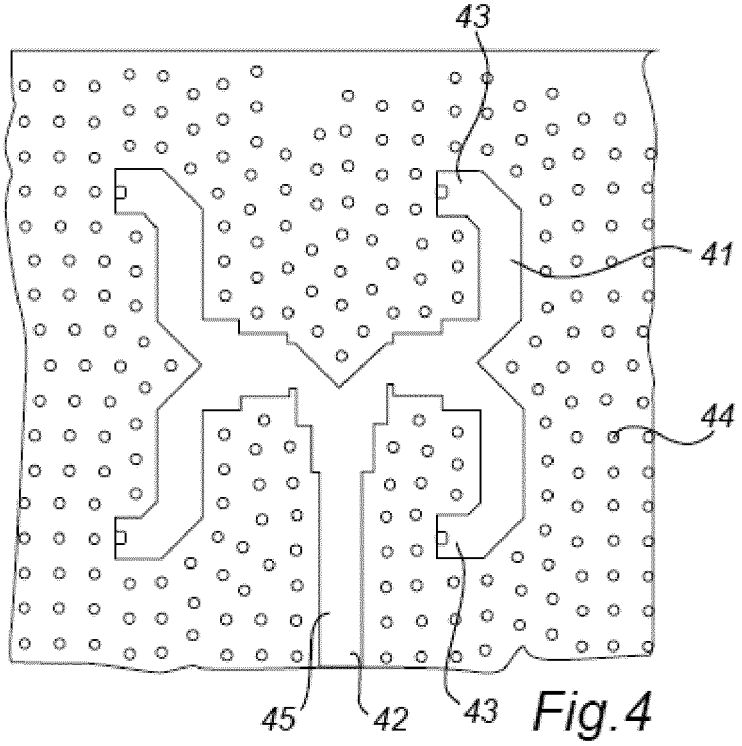
FIG. 4 is a top view of an exemplary distribution network realized in accordance with the present invention, and usable e.g. in the antenna of FIG. 3.

In FIG. 4, a top view of an example of the texture in the lower gap waveguide layer of the antenna in FIG. 3 is illustrated. This shows a distribution network 41 in ridge gap waveguide technology in accordance with [13], for waves in the gap between the two lower conducting layers. The ridge structure forms a branched so-called corporate distribution network from one input port 42 to four output ports 43. The distribution network may be much larger than this with many more output ports to feed a larger array. In contrast to the antenna of [13], the via-holes arranged to provide a stopping texture are here formed as protruding elements 44 monolithically formed in the above-described manner. Hereby, there is no or partly no substrate and the via holes are replaced by the protruding elements/pins. The ridge structure may be formed in the same way, to be monolithically arranged on the conductive layer. Hereby, the ridge becomes a solid ridge such as shown in the ridge gap waveguides in e.g. [4]. Alternatively, the ridge may be drawn as a thin metal strip, a microstrip, supported by pins.

Figure 5:
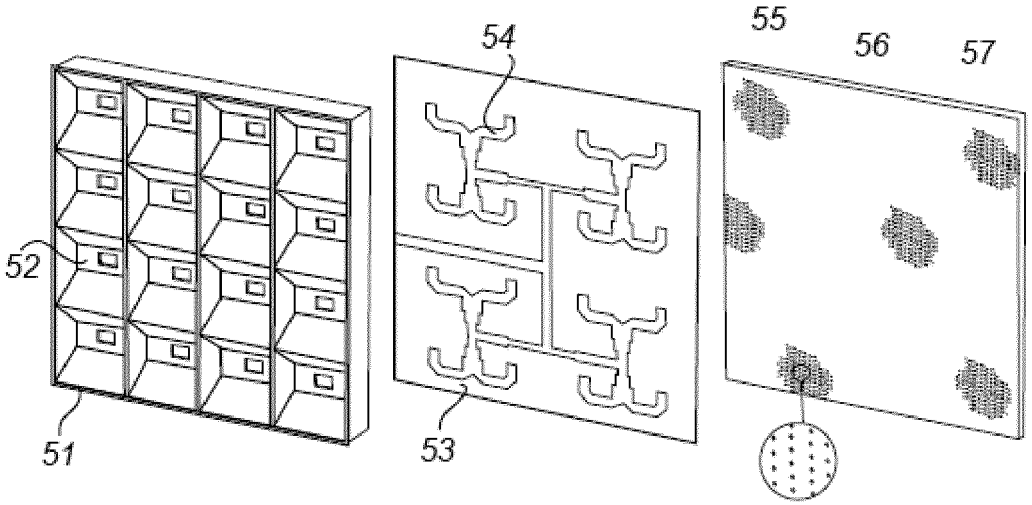
FIG. 5 is a perspective and exploded view of three different layers of an antenna in accordance with another alternative embodiment of the present invention making use of an inverted microstrip gap waveguide.

With reference to FIG. 5, another embodiment of an antenna will now be discussed. This antenna comprises three layers, illustrated separately in an exploded view. The upper layer 51 (left) comprises an array of radiating horn elements 52 formed therein. The middle layer 53 is arranged at a distance from the upper layer 51, so that a gap towards the upper layer is provided. This middle layer 53 comprises a microstrip distribution network 54 arranged on a substrate having no ground plane. The waves propagate in the air gap between the upper and middle layer, and above the microstrip paths. A lower layer 55 (right) is arranged beneath and in contact with the middle layer 53. This lower layer comprises an array of protruding elements 56, such as metal pins, monolithically manufactured in the above-discussed manner on a conducting layer 57. The conducting layer may be formed as a separate metal layer or as a metal surface of an upper ground plane of a PCB. The protruding elements are integrally connected to the conducting layer in such a way that metal contact between the bases of all protruding elements is ensured.

Thus, this antenna functionally and structurally resembles the antenna disclosed in [12], said document hereby being incorporated in its entirety by reference. However, whereas this known antenna was realized by milling to form an inverted microstrip gap waveguide network, the present example provides a distribution network realized as a monolithically formed gap waveguide, which entails many advantages, as has been discussed thoroughly in the foregoing sections of this application.

Figure 6:
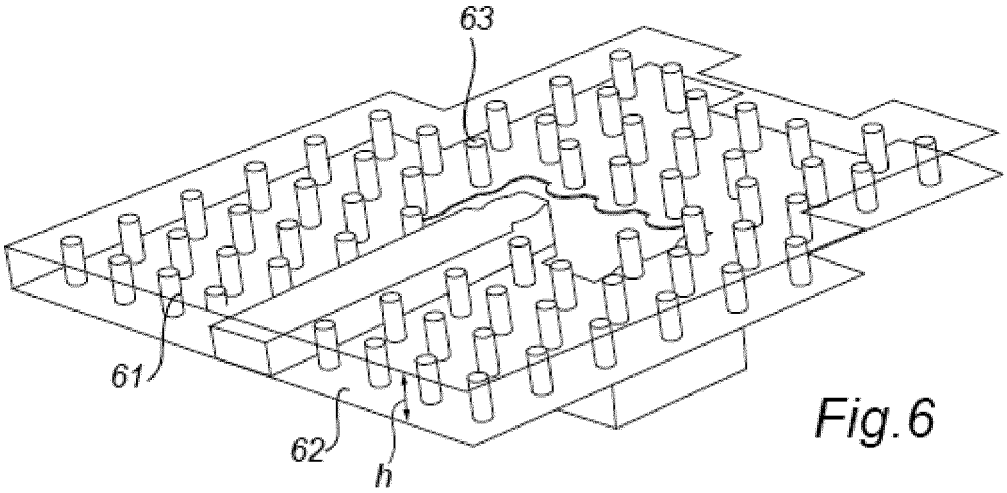
FIG. 6 is a close-up view of an input port of a ridge gap waveguide in accordance with a further embodiment of the present invention.

FIG. 6 provides a close-up view of an input port of a microstrip-ridge gap waveguide on a lower layer showing a transition to a rectangular waveguide through a slot 63 in the ground plane. In this embodiment, there is no dielectric substrate present, and the conventionally used via holes are replaced by protruding elements 61, monolithically connected to a conducting layer 62 in such a way that there is electric contact between all the protruding elements 61. Thus, a microstrip gap waveguide is provided. The upper metal surface is removed for clarity. The microstrip supported by pins, i.e. the microstrip-ridge, may also be replaced by a solid ridge in the same way as discussed above in connection with FIG. 4.

Figure 7:
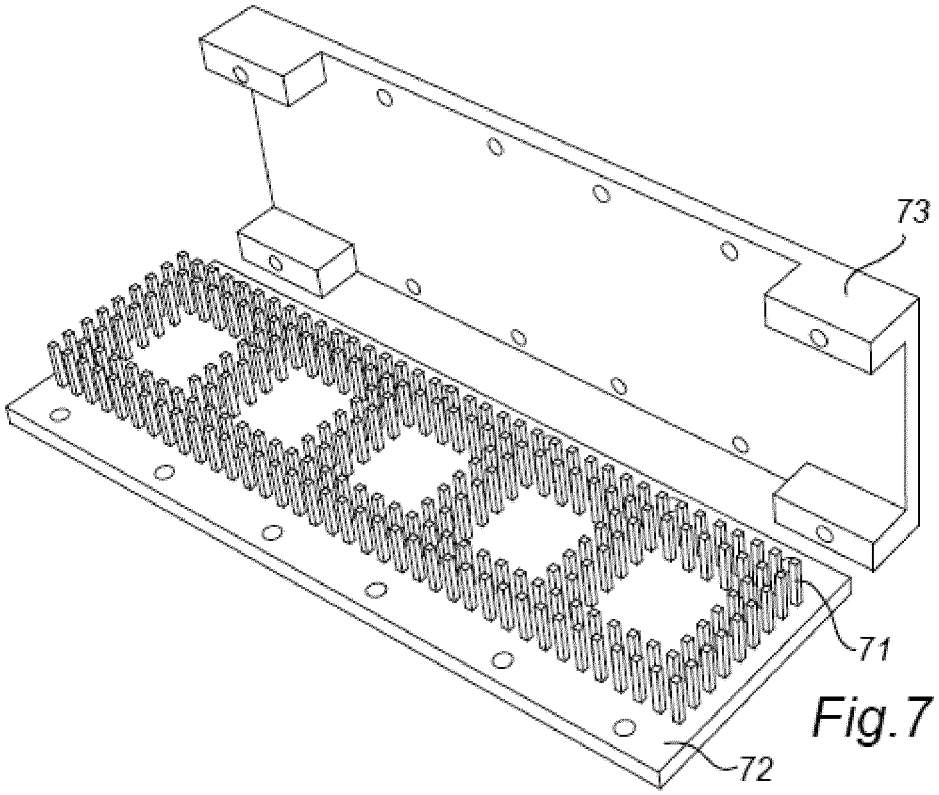
FIGS. 7 and 8 are perspective views of partly disassembled gap waveguide filters in accordance with a further embodiments of the present invention.

FIG. 7 illustrates an exemplary embodiment of a gap waveguide filter, structurally and functionally similar to the one disclosed in [14], said document hereby being incorporated in its entirety by reference. However, contrary to the waveguide filter disclosed in this document, the protruding elements 71 arranged on a lower conducting layer 72 are here formed by monolithically and integrally formed protruding elements in the above-discussed fashion. An upper conducting layer 73 is arranged above the protruding elements, in the same way as disclosed in [12]. Thus, this then becomes a groove gap waveguide filter.

Figure 8:
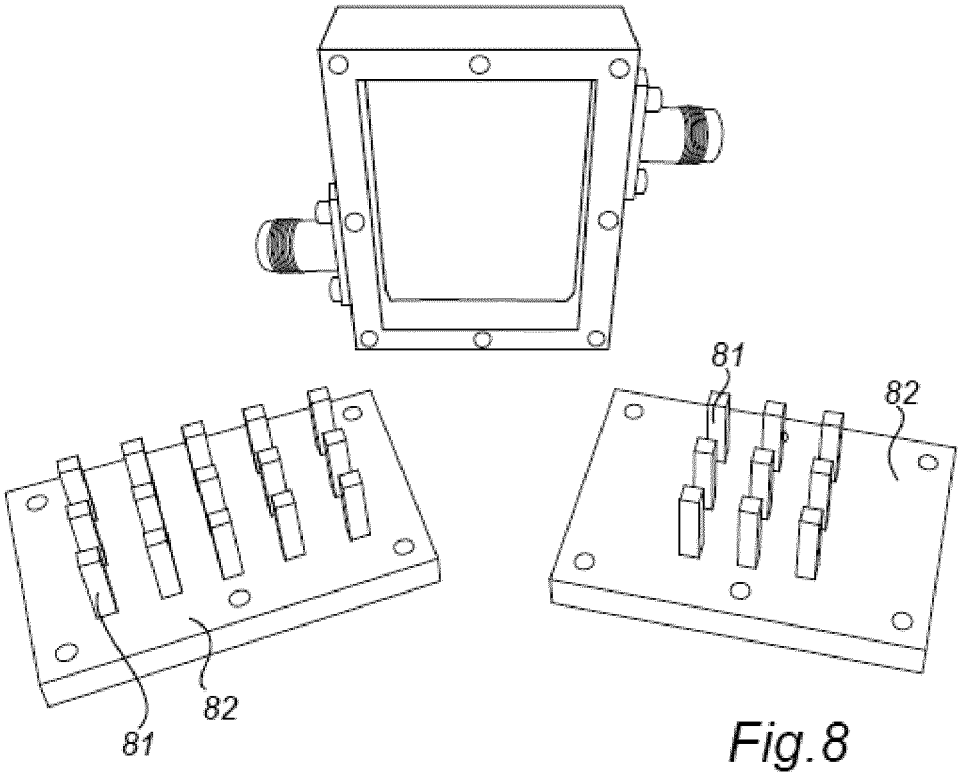

FIG. 8 provides another example of a waveguide filter, which may also be referred to as gap-waveguide-packaged microstrip filter. This filter functionally and structurally resembles the filter disclosed in [15], said document hereby being incorporated in its entirety by reference. However, contrary to the filter disclosed in [15], the filter here is packaged by a surface having protruding elements, in which protruding elements 81 provided on a conducting layer 82 are realized in the above-described way. Two alternative lids, comprising different number and arrangement of the protruding elements 81 are illustrated.

Figure 9A:
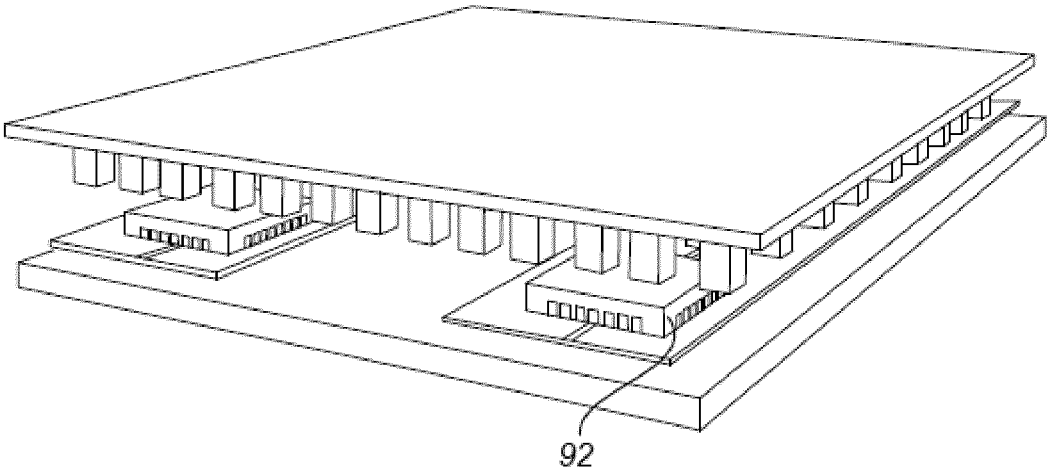
FIG. 9*a* is a schematic perspective view seen from the side and FIG. 9*b* is a side view.
Figure 9B:
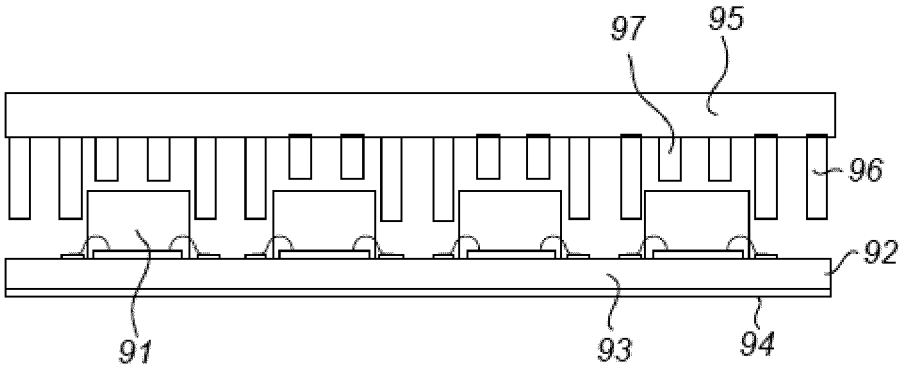

With reference to FIG. 9, an embodiment providing a package for integrated circuit(s) will be discussed. In this example, the integrated circuits are MMIC amplifier modules 91, arranged in a chain configuration on a lower plate 92, here realized as a PCB having an upper main substrate, provided with a lower ground plane 93. A lid is provided, formed by a conducting layer 95, e.g. made of aluminum or any other suitable metal. The lid may be connected to the lower plate 92 by means of a surrounding frame or the like.

The lid is further provided with protruding elements 96, 97, protruding towards the lower plate 92. This is functionally and structurally similar to the package disclosed in [16], said document hereby being incorporated in its entirety by reference. The protruding elements are preferably of different heights, so that the elements overlying the integrated circuits 91 are of a lower height, and the elements overlying areas laterally outside the integrated circuits are of a greater height. Hereby, holes are formed in the surface presented by the protruding elements, in which the integrated circuits are inserted. The protruding elements are in electric contact with the upper layer 95, and electrically connected to each other by this layer. However, the protruding elements are preferably not in contact neither with the lower plate 92, nor the integrated circuit modules 91.

Here, and contrary to the disclosure in [16], the protruding elements are formed on the upper layer 95 monolithically. This packaging is consequently an example of using the gap waveguide as discussed above as a packaging technology, according to the present invention.

An equipment and method for manufacturing of the monolithically formed RF part will next be described in further detail, with reference to FIGS. 10-17.

Figure 10:
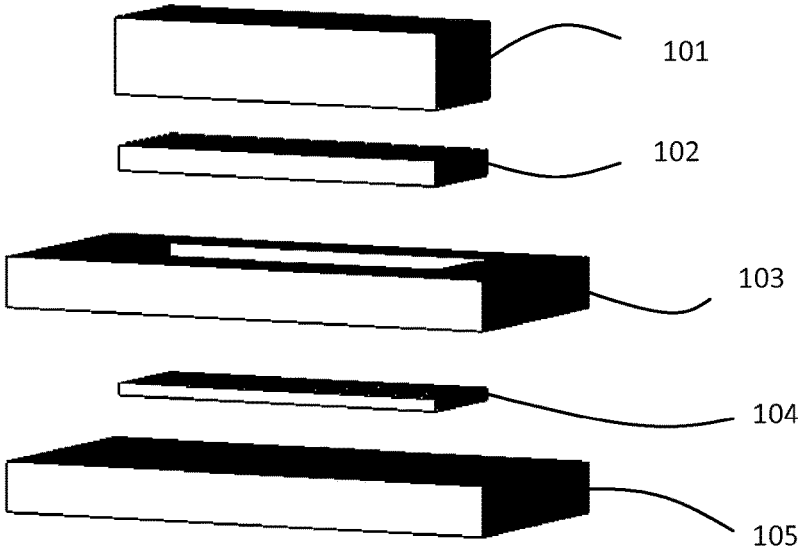
FIG. 10 is a schematic exploded view of a manufacturing equipment in accordance with one embodiment of the present invention.
Figure 11:
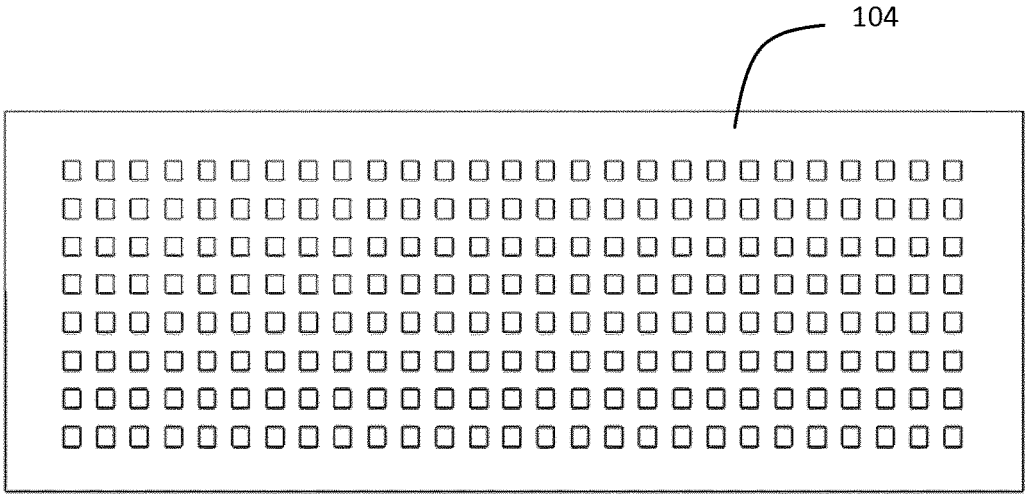
FIG. 11 is a top view of the die forming layer in FIG. 10.

With reference to FIG. 10, a first embodiment of an apparatus for producing an RF part comprises a die comprising a die layer 104 being provided with a plurality of recessions forming the negative of the protruding elements of the RF part. An example of such a die layer 104 is illustrated in FIG. 11. This die layer 104 comprises a grid array of evenly dispersed through-holes, to form a corresponding grid array of protruding elements. The recessions are here of a rectangular shape, but other shapes, such as circular, elliptical, hexagonal or the like, may also be used. Further, the recessions need not have a uniform cross-section over the height of the die layer. The recessions may be cylindrical, but may also be conical, or assume other shapes having varying diameters.

Figure 12:
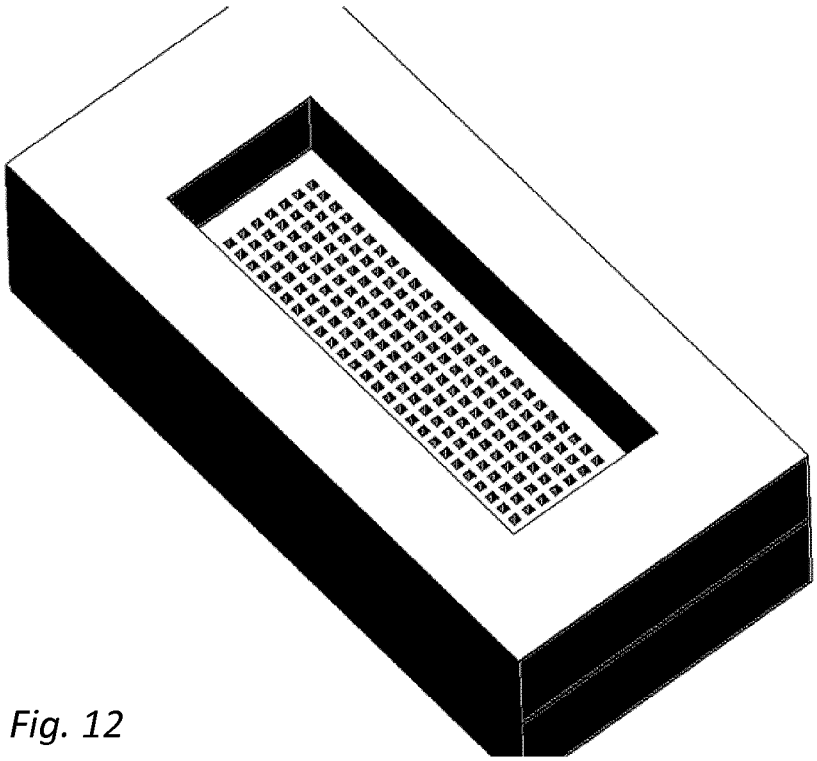
FIG. 12 is a perspective view of the assembled die of FIG. 10.

The die further comprises a collar 103 arranged around said at least one die layer. The collar and die layer are preferably dimensioned to that the die layer has a close fit with the interior of the collar. In FIG. 12, the die layer arranged within the collar is illustrated.

The die further comprises a base plate 105 on which the die layer and the collar are arranged. In case the die comprises through-holes, the base plate will form the bottom of the cavities provided by the through-holes.

Figure 13:
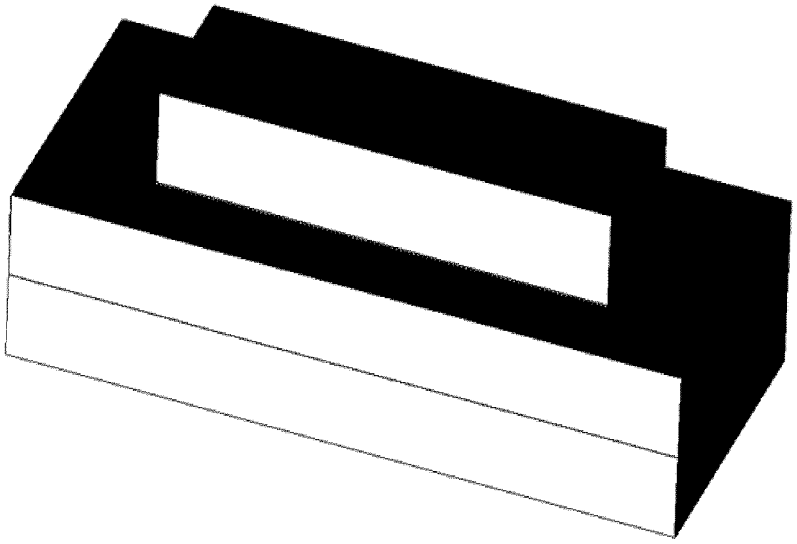
FIG. 13 is a perspective view of the manufacturing equipment of FIG. 10 in an assembled disposition.

A formable piece 102 of material is further arranged within the collar, to be depressed onto the die layer 104. Pressure may be applied directly to the formable piece of material, but preferably, a stamp 101 is arranged on top of the formable piece of material, in order to distribute the pressure evenly. The stamp is preferably also arranged to be insertable into the collar, and having a close fit with the interior of the collar. In FIG. 13, the stamp 101 arranged on top of the formable piece of material in the collar 103 is illustrated in an assembled disposition.

The above-discussed arrangement may be arranged in a conventional pressing arrangement, such as a mechanical or hydraulic press, to apply a pressure on the stamp and the base plate of the die, thereby compressing the formable piece of material to conform with the recessions of the at least one die layer.

The multilayer die press or coining arrangement discussed above can provide protruding elements/pins, ridges and other protruding structures in the formable piece of material having the same height. Through-holes are obtainable e.g. by means of drilling. In case non-through going recessions are used in the die layer, this arrangement may also be used to produce such protruding structures having varying heights.

However, in order to produce protruding structures having varying heights, it is also possible to use several die layers, each having through-holes. Such an embodiment will now be discussed with reference to FIGS. 14-17.

Figure 14:
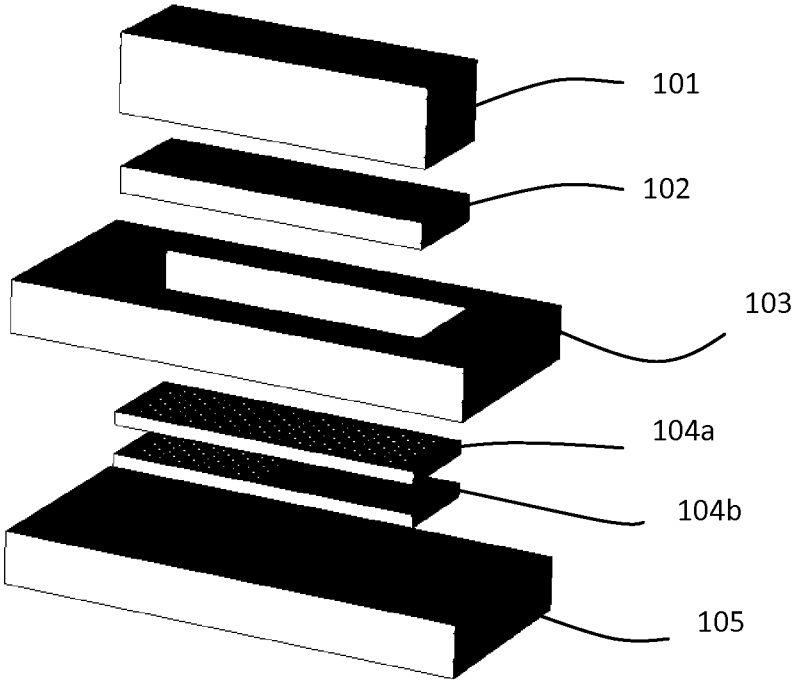
FIG. 14 is a schematic exploded view of a manufacturing equipment in accordance with another embodiment of the present invention.
Figure 15:
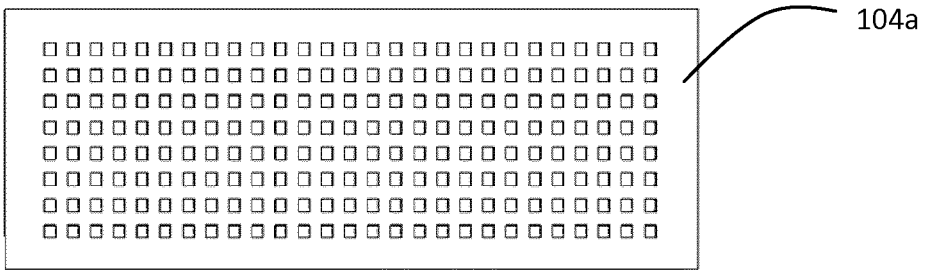
FIGS. 15 and 16 are top views illustrating the two die forming layers in the embodiment of FIG. 14.
Figure 16:
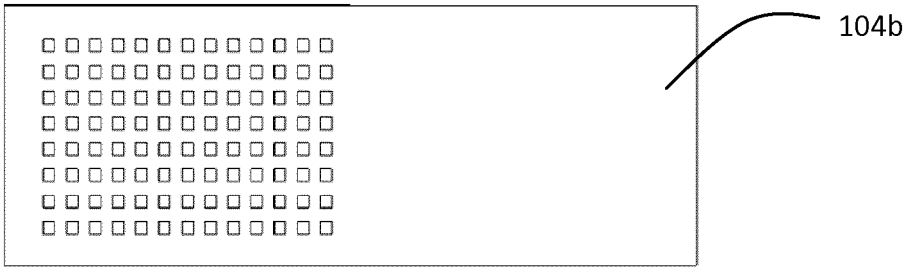
Figure 17:
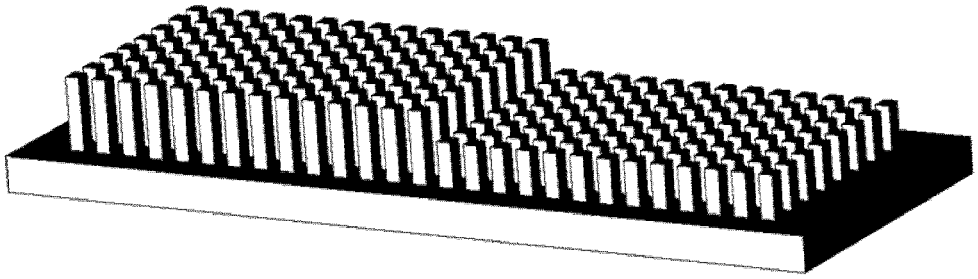
FIG. 17 is a perspective view showing an RF part producible by the manufacturing equipment of FIG. 14.

With reference to the exploded view of FIG. 14, this apparatus comprises the same layers/components as in the previously discussed embodiment. However, here two separate die layers 104*a* and 104*b* are provided. Examples of such die layers are illustrated in FIGS. 15 and 16. The die layer 104*a* (shown in FIG. 15) being arranged closest to the formable piece of material 102 is provided with a plurality of through-holes. The other die layer 104*b* (shown in FIG. 16), being farther from the formable piece of material 102 comprises fewer recessions. The recessions of the second die layer 104*b* are preferably correlated with corresponding recessions in the first die layer 104*a*. Hereby, some recessions of the first die layer will end at the encounter with the second die layer, to form short protruding elements, whereas some will extend also within the second die layer, to form high protruding elements. Hereby, by adequate formation of the die layer, it is relatively simple to produce protruding element of various heights, An example of an RF part having protruding elements of varying heights, in accordance with the embodiments of the die layers illustrated in FIGS. 15 and 16, is shown in FIG. 17.

In the foregoing, the stamp 101, collar 103, die layer(s) 104 and base plate 105 are exemplified as separate elements, being detachably arranged on top of each other. However, these elements may also be permanently or detachably connected to each other, or formed as integrated units, in various combinations. For example, the base plate 105 and collar 103 may be provided as a combined unit, the die layer may be connected to the collar and/or the base plate, etc.

The pressing in which pressure is applied to form the formable material in conformity with the die layer may be performed at room temperature. However, in order to facilitate the formation, especially when relatively hard materials are used, heat may also be applied to the formable material. For example if aluminum is used as the formable material, the material may be heated to a few hundred degrees C., or even up to 500 deg. C. If tin is used, the material may be heated to 100-150 deg. C. By applying heat, the forming can be faster, and less pressure is needed.

To facilitate removal of the formable material from the die/die layer after the forming, the recessions can be made slightly conical or the like. It is also possible to apply heat or cold to the die and formable material. Since different materials have different coefficients of thermal expansion, the die and formable material will contract and expand differently when cold and or heat is applied. For example, tin has a much lower coefficient of thermal expansion than steel, so if the die is made of steel and the formable material of tin, removal will be much facilitated by cooling. Cooling may e.g. be made by dipping or in other way exposing the die and/or formable material to liquid nitrogen.

The invention has now been described with reference to specific embodiments. However, several variations of the technology of the waveguide and RF packaging in the antenna system are feasible. For example, the here disclosed realization of protruding elements can be used in many other antenna systems and apparatuses in which conventional gap waveguides have been used or could be contemplated. Such and other obvious modifications must be considered to be within the scope of the present invention, as it is defined by the appended claims. It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements. Further, a single unit may perform the functions of several means recited in the claims.

REFERENCES

[1] J. Hirokawa and M. Ando, "Efficiency of 76-GHz post-wall waveguide-fed parallel-plate slot arrays," *IEEE Trans. Antenna Propag.*, vol. 48, no. 11, pp. 1742-1745, November 2000.

[2] Per-Simon Kildal, "Waveguides and transmission lines in gaps between parallel conducting surfaces", patent application No. PCT/EP2009/057743, 22 Jun. 2009.

[3] P.-S. Kildal, E. Alfonso, A. Valero-Nogueira, E. Rajo-Iglesias, "Local metamaterial-based waveguides in gaps between parallel metal plates," *IEEE Antennas and Wireless Propagation letters*, vol. 8, pp. 84-87, 2009.

[4] P.-S. Kildal, A. Uz Zaman, E. Rajo-Iglesias, E. Alfonso and A. Valero-Nogueira, "Design and experimental verification of ridge gap waveguides in bed of nails for parallel plate mode suppression," *IET Microwaves, Antennas & Propagation*, vol. 5, iss. 3, pp. 262-270, March 2011.

[5] E. Rajo-Iglesias, P.-S. Kildal, "Numerical studies of bandwidth of parallel plate cut-off realized by bed of nails, corrugations and mushroom-type EBG for use in gap waveguides," *IET Microwaves, Antennas & Propagation*, vol. 5, no. 3, pp. 282-289, March 2011.

[6] P.-S. Kildal, "Three metamaterial-based gap waveguides between parallel metal plates for mm/submm waves", 3rd *European Conference on Antennas and Propagation*, Berlin, March 2009.

[7] E. Rajo-Iglesias, P.-S. Kildal, "Numerical studies of bandwidth of parallel plate cut-off realized by bed of nails, corrugations and mushroom-type EBG for use in gap waveguides," *IET Microwaves, Antennas & Propagation*, vol. 5, no. 3, pp. 282-289, March 2011.

[8] A. Valero-Nogueira, J. Domenech, M. Baquero, J. I. Herranz, E. Alfonso, and A. Vila, "Gap waveguides using a suspended strip on a bed of nails," *IEEE Antennas and Wireless Propag. Letters*, vol. 10, pp. 1006-1009, 2011

[9] E. Pucci, E. Rajo-Iglesias, P.-S. Kildal, "New Microstrip Gap Waveguide on Mushroom-Type EBG for Packaging of Microwave Components", IEEE Microwave and Wireless Components Letters, Vol. 22, No. 3, pp. 129-131, March 2012.

[10] E. Pucci, E. Rajo-Iglesias, J.-L. Vasquuez-Roy, P.-S. Kildal, "Planar Dual-Mode Horn Array with Corporate-Feed Network in Inverted Microstrip Gap Waveguide", accepted for publication in IEEE Transactions on Antennas and Propagation, March 2014.

[11] E. Pucci, A. U. Zaman, E. Rajo-Iglesias, P.-S. Kildal, "New low loss inverted microstrip line using gap waveguide technology for slot antenna applications", 6th European Conference on Antennas and Propagation EuCAP 2011, Rome, 11-15 Apr. 2011.

[12] E. Pucci, E. Rajo-Iglesias, J.-L. Vazquez-Roy and P.-S. Kildal, "Design of a four-element horn antenna array fed by inverted microstrip gap waveguide", 2013 IEEE International Symposium on Antennas and Propagation (IEEE AP-S 2013), Orlando, USA, Jul. 7-12, 2013.

[13] Seyed Ali Razavi , Per-Simon Kildal, Liangliang Xiang, Haiguang Chen, Esperanza Alfonso, "Design of 60GHz Planar Array Antennas Using PCB-based Microstrip-Ridge Gap Waveguide and SIW", 8th European Conference on Antennas and Propagation EuCAP 2014, The Hague, The Netherlands, 6-11 Apr. 2014.

[14] A. U. Zaman, A. Kishk, and P.-S. Kildal, "Narrow-band microwave filter using high Q groove gap waveguide resonators without sidewalls", IEEE Transactions on Components, Packaging and Manufacturing Technology, Vol. 2, No. 11, pp. 1882-1889, November 2012.

[15] A. Algaba Brazález, A. Uz Zaman, P.-S. Kildal, "Improved Microstrip Filters Using PMC Packaging by Lid of Nails", IEEE Transactions on Components, Packaging and Manufacturing Technology, Vol. 2, No. 7, July 2012.

[16] A. U. Zaman, T. Vukusic, M. Alexanderson, P.-S. Kildal, "Gap Waveguide PMC Packaging for Improved Isolation of Circuit Components in High Frequency Microwave Modules", IEEE Transactions on Components, Packaging and Manufacturing Technology, Vol. 4, Issue 1, p. 16-25, 2014.

The invention claimed is:

1. A radio frequency (RF) part of an antenna system, comprising at least two conducting layers arranged with a gap there between, and a set of periodically or quasi-periodically arranged protruding elements fixedly connected to at least one of said conducting layers, thereby forming a texture to stop wave propagation in a frequency band of operation in other directions than along intended waveguiding paths, wherein said protruding elements are monolithically formed on said at least one conducting layer, whereby each protruding element is monolithically fixed to the at least one conducting layer, all protruding elements being connected electrically to each other at their bases via said at least one conductive layer on which they are fixedly connected, further comprising at least one integrated circuit module arranged between said at least two conducting layers, the texture to stop wave propagation thereby functioning as a means of removing resonances within a package for said at least one integrated circuit module.

2. The RF part of claim 1, wherein the protruding elements being monolithically formed on said at least one conducting layer are formed by coining.

3. The RF part of claim 1, wherein the RF part is a waveguide, and wherein the protruding elements are further in contact with also another conducting layer of the at least two conducting layers, and wherein the protruding elements are arranged to at least partly surround a cavity between said at least two conducting layers, said cavity thereby functioning as the waveguide.

4. The RF part of claim 1, wherein the RF part is a gap waveguide, and further comprising at least one groove, ridge or microstrip line along which waves are to propagate.

5. The RF part of claim 1, wherein the RF part is a gap waveguide, and further comprising at least one ridge along which waves are to propagate, said at least one ridge being arranged on the same conducting layer as the protruding elements, and also being monolithically formed on said at least one conducting layer.

6. The RF part of claim 1, wherein each of the protruding elements have maximum cross-sectional dimensions of less than half a wavelength in air at the operating frequency, and/or wherein each of the protruding elements in the texture stopping wave propagation are spaced apart by a spacing being smaller than half a wavelength in air at the operating frequency.

7. The RF part of claim 1, wherein the protruding elements forming said texture to stop wave propagation are only in contact with one of the at least two conducting layers.

8. The RF part of claim 1, wherein one of the at least two conducting layers is provided with at least one opening, said at least one opening allowing radiation to be transmitted to and/or received from said RF part.

9. The RF part of claim 1, wherein one of the at least two conducting layers is a conducting layer not being provided with said protruding elements, wherein the at least one integrated circuit module is arranged on the conducting layer not being provided with said protruding elements, and wherein protruding elements overlying the at least one integrated circuit module are shorter than protruding elements not overlying said at least one integrated circuit module.

10. A flat array antenna comprising a corporate distribution network realized by the RF part in accordance with claim 1.

* * * * *